US009556681B2

(12) United States Patent
Kulkarni

(10) Patent No.: US 9,556,681 B2
(45) Date of Patent: Jan. 31, 2017

(54) EXTERNAL, DIVORCED PDC BEARING ASSEMBLIES FOR HYBRID DRILL BITS

(71) Applicant: BAKER HUGHES INCORPORATED, Houston, TX (US)

(72) Inventor: Ajay V. Kulkarni, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/643,459

(22) Filed: Mar. 10, 2015

(65) Prior Publication Data

US 2015/0285003 A1 Oct. 8, 2015

Related U.S. Application Data

(63) Continuation of application No. 12/883,900, filed on Sep. 16, 2010, now Pat. No. 9,004,198.

(60) Provisional application No. 61/243,048, filed on Sep. 16, 2009.

(51) Int. Cl.

| | |
|---|---|
| ***E21B 10/22*** | (2006.01) |
| ***E21B 10/20*** | (2006.01) |
| ***E21B 10/14*** | (2006.01) |

(52) U.S. Cl.

CPC ..... *E21B 10/22* (2013.01); *E21B 10/14* (2013.01); *E21B 10/20* (2013.01)

(58) Field of Classification Search

CPC ..... E21B 10/22; E21B 10/14; E21B 10/06; E21B 10/20

See application file for complete search history.

(56) References Cited

U.S. PATENT DOCUMENTS

| | | | |
|---|---|---|---|
| 930,759 | A | 8/1909 | Hughes |
| 1,388,424 | A | 9/1921 | George |
| 1,394,769 | A | 10/1921 | Sorensen |
| 1,519,641 | A | 12/1924 | Thompson |
| 1,537,550 | A | 5/1925 | Reed |
| 1,729,062 | A | 9/1929 | Bull |
| 1,801,720 | A | 4/1931 | Bull |
| 1,816,568 | A | 7/1931 | Carlson |
| 1,821,474 | A | 9/1931 | Mercer |
| 1,874,066 | A | 8/1932 | Scott et al. |
| 1,879,127 | A | 9/1932 | Schlumpf |
| 1,896,243 | A | 2/1933 | Macdonald |

(Continued)

FOREIGN PATENT DOCUMENTS

| | | |
|---|---|---|
| DE | 1301784 | 8/1969 |
| EP | 0225101 | 6/1987 |

(Continued)

OTHER PUBLICATIONS

Baharlou, International Preliminary Report of Patentability for International Patent Application No. PCT/US2009/050672, The International Bureau of WIPO, dated Jan. 25, 2011.

(Continued)

*Primary Examiner* — Michael Wills, III
(74) *Attorney, Agent, or Firm* — TraskBritt

(57) ABSTRACT

A hybrid-type earth boring drill bit is described having fixed cutting blades and rolling cones with cutting elements, wherein the rolling cones are associated with a spindle assembly that may be optionally divorced from the head pin assembly, and which includes bearing members that further include a plurality of polycrystalline diamond elements.

17 Claims, 8 Drawing Sheets

(56) References Cited

U.S. PATENT DOCUMENTS 1,932,487 A 10/1933 Scott
2,030,722 A 2/1936 Scott
2,117,481 A 5/1938 Howard et al.
2,119,618 A 6/1938 Zublin
2,184,067 A 12/1939 Zublin
2,198,849 A 4/1940 Waxler
2,204,657 A 6/1940 Clyde
2,216,894 A 10/1940 Stancliff
2,244,537 A 6/1941 Kammerer
2,297,157 A 9/1942 McClinton
2,318,370 A 5/1943 Burch
2,320,136 A 5/1943 Kammerer
2,320,137 A 5/1943 Kammerer
2,358,642 A 9/1944 Kammerer
2,380,112 A 7/1945 Kinnear
2,533,259 A 6/1946 Woods et al.
2,520,517 A 8/1950 Taylor
2,533,258 A 12/1950 Morlan et al.
2,557,302 A 6/1951 Maydew
RE23,416 E 10/1951 Kinnear
2,575,438 A 11/1951 Arthur et al.
2,628,821 A 2/1953 Arthur et al.
2,661,931 A 12/1953 Swart
2,719,026 A 9/1955 Boice
2,725,215 A 11/1955 Macneir
2,815,932 A 12/1957 Wolfram
2,994,389 A 8/1961 Bus, Sr.
3,010,708 A 11/1961 Hlinsky et al.
3,039,503 A 6/1962 Mainone
3,050,293 A 8/1962 Hlinsky
3,055,443 A 9/1962 Edwards
3,066,749 A 12/1962 Hildebrandt
3,126,066 A 3/1964 Williams, Jr.
3,126,067 A 3/1964 Schumacher, Jr.
3,174,564 A 3/1965 Morlan
3,239,431 A 3/1966 Raymond
3,250,337 A 5/1966 Demo
3,269,469 A 8/1966 Kelly, Jr.
3,387,673 A 6/1968 Thompson
3,397,751 A 8/1968 Reichmuth
3,424,258 A 1/1969 Nakayama
3,583,501 A 6/1971 Aalund
3,760,894 A 9/1973 Pitifer
RE28,625 E 11/1975 Cunningham
3,998,500 A * 12/1976 Dixon ..... E21B 10/18 175/337
4,006,788 A 2/1977 Garner
4,108,259 A 8/1978 Dixon et al.
4,140,189 A 2/1979 Garner
4,187,922 A 2/1980 Phelps
4,190,126 A 2/1980 Kabashima
4,190,301 A 2/1980 Lachonius et al.
4,260,203 A 4/1981 Garner
4,270,812 A 6/1981 Thomas
4,285,409 A 8/1981 Allen
4,293,048 A 10/1981 Kloesel, Jr.
4,314,132 A 2/1982 Porter
4,320,808 A 3/1982 Garrett
4,343,371 A 8/1982 Baker, III et al.
4,359,112 A 11/1982 Garner et al.
4,359,114 A 11/1982 Miller et al.
4,369,849 A 1/1983 Parrish
4,386,669 A 6/1983 Evans
4,408,671 A 10/1983 Munson
4,410,284 A 10/1983 Herrick
4,428,687 A 1/1984 Zahradnik
4,444,281 A 4/1984 Schumacher, Jr. et al.
4,448,269 A 5/1984 Ishikawa et al.
4,456,082 A 6/1984 Harrison
4,468,138 A 8/1984 Nagel
4,527,637 A 7/1985 Bodine
4,527,644 A 7/1985 Allam
4,572,306 A 2/1986 Dorosz
4,600,064 A 7/1986 Scales et al.
4,627,882 A 12/1986 Soderstrom
4,641,718 A 2/1987 Bengtsson
4,657,091 A 4/1987 Higdon
4,664,705 A 5/1987 Horton et al.
4,690,228 A 9/1987 Voelz et al.
4,706,765 A 11/1987 Lee et al.
4,726,718 A 2/1988 Meskin et al.
4,727,942 A 3/1988 Galle et al.
4,729,440 A 3/1988 Hall
4,738,322 A 4/1988 Hall et al.
4,756,631 A 7/1988 Jones
4,763,736 A 8/1988 Varel
4,765,205 A 8/1988 Higdon
4,802,539 A 2/1989 Hall et al.
4,819,703 A 4/1989 Rice et al.
4,825,964 A 5/1989 Rives
4,865,137 A 9/1989 Bailey et al.
4,874,047 A 10/1989 Hixon
4,875,532 A 10/1989 Langford, Jr.
4,880,068 A 11/1989 Bronson
4,892,159 A 1/1990 Holster
4,892,420 A 1/1990 Kruger
4,915,181 A 4/1990 Labrosse
4,932,484 A 6/1990 Warren et al.
4,936,398 A 6/1990 Auty et al.
4,943,488 A 7/1990 Sung et al.
4,953,641 A 9/1990 Pessier
4,976,324 A 12/1990 Tibbitts
4,981,184 A 1/1991 Knowlton et al.
4,984,643 A 1/1991 Isbell et al.
4,991,671 A 2/1991 Pearce et al.
5,016,718 A 5/1991 Tandberg
5,027,912 A 7/1991 Juergens
5,027,914 A 7/1991 Wilson
5,028,177 A 7/1991 Meskin et al.
5,030,276 A 7/1991 Sung et al.
5,037,212 A 8/1991 Justman et al.
5,049,164 A 9/1991 Horton et al.
5,092,687 A 3/1992 Hall
5,116,568 A 5/1992 Sung et al.
5,137,097 A 8/1992 Fernandez
5,145,017 A 9/1992 Holster et al.
5,176,212 A 1/1993 Tandberg
5,199,516 A 4/1993 Fernandez
5,224,560 A 7/1993 Fernandez
5,238,074 A 8/1993 Tibbitts et al.
5,253,939 A 10/1993 Hall
5,287,936 A 2/1994 Grimes et al.
5,289,889 A 3/1994 Gearhart et al.
5,337,843 A 8/1994 Torgrimsen et al.
5,342,129 A 8/1994 Dennis et al.
5,346,026 A 9/1994 Pessier et al.
5,351,770 A 10/1994 Cawthorne et al.
5,361,859 A 11/1994 Tibbitts
5,429,200 A 7/1995 Blackman et al.
5,439,067 A 8/1995 Huffstutler
5,439,068 A 8/1995 Huffstutler et al.
5,452,771 A 9/1995 Blackman et al.
5,467,836 A 11/1995 Grimes et al.
5,472,057 A 12/1995 Winfree
5,472,271 A 12/1995 Bowers et al.
5,494,123 A 2/1996 Nguyen
5,513,715 A 5/1996 Dysart
5,518,077 A 5/1996 Blackman et al.
5,531,281 A 7/1996 Murdock
5,547,033 A 8/1996 Campos, Jr.
5,553,681 A 9/1996 Huffstutler et al.
5,558,170 A 9/1996 Thigpen et al.
5,560,440 A 10/1996 Tibbitts
5,570,750 A 11/1996 Williams
5,593,231 A 1/1997 Ippolito
5,595,255 A 1/1997 Huffstutler
5,606,895 A 3/1997 Huffstutler
5,624,002 A 4/1997 Huffstutler
5,641,029 A 6/1997 Beaton et al.
5,644,956 A 7/1997 Blackman et al.
5,655,612 A 8/1997 Grimes et al.
D384,084 S 9/1997 Huffstutler et al.
5,695,018 A 12/1997 Pessier et al.
5,695,019 A 12/1997 Shamburger, Jr.

(56) References Cited

U.S. PATENT DOCUMENTS 5,755,297 A 5/1998 Young et al.
5,839,526 A 11/1998 Cisneros et al.
5,862,871 A 1/1999 Curlett
5,868,502 A 2/1999 Cariveau et al.
5,873,422 A 2/1999 Hansen et al.
5,941,322 A 8/1999 Stephenson et al.
5,944,125 A 8/1999 Byrd
5,967,246 A 10/1999 Caraway et al.
5,979,576 A 11/1999 Hansen et al.
5,988,303 A 11/1999 Arfele
5,992,542 A 11/1999 Rives
5,996,713 A 12/1999 Pessier et al.
6,045,029 A 4/2000 Scott
6,068,070 A 5/2000 Scott
6,092,613 A 7/2000 Caraway et al.
6,095,265 A 8/2000 Alsup
6,109,375 A 8/2000 Tso
6,116,357 A 9/2000 Wagoner et al.
6,170,582 B1 1/2001 Singh et al.
6,173,797 B1 1/2001 Dykstra et al.
6,190,050 B1 2/2001 Campbell
6,209,185 B1 4/2001 Scott
6,220,374 B1 4/2001 Crawford
6,241,034 B1 6/2001 Steinke et al.
6,241,036 B1 6/2001 Lovato et al.
6,250,407 B1 6/2001 Karlsson
6,260,635 B1 7/2001 Crawford
6,279,671 B1 8/2001 Panigrahi et al.
6,283,233 B1 9/2001 Lamine et al.
6,296,069 B1 10/2001 Lamine et al.
RE37,450 E 11/2001 Deken et al.
6,345,673 B1 2/2002 Siracki
6,360,831 B1 3/2002 Akesson et al.
6,367,568 B2 4/2002 Steinke et al.
6,386,302 B1 5/2002 Beaton
6,401,844 B1 6/2002 Doster et al.
6,405,811 B1 6/2002 Borchardt
6,408,958 B1 6/2002 Isbell et al.
6,415,687 B2 7/2002 Saxman
6,427,791 B1 8/2002 Glowka
6,427,798 B1 8/2002 Imashige
6,439,326 B1 8/2002 Huang et al.
6,446,739 B1 9/2002 Richman et al.
6,450,270 B1 9/2002 Saxton
6,460,635 B1 10/2002 Kalsi et al.
6,474,424 B1 11/2002 Saxman
6,510,906 B1 1/2003 Richert et al.
6,510,909 B2 1/2003 Portwood et al.
6,527,066 B1 3/2003 Rives
6,533,051 B1 3/2003 Singh et al.
6,544,308 B2 4/2003 Griffin et al.
6,561,291 B2 5/2003 Xiang
6,562,462 B2 5/2003 Griffin et al.
6,568,490 B1 5/2003 Tso et al.
6,581,700 B2 6/2003 Curlett et al.
6,585,064 B2 7/2003 Griffin et al.
6,589,640 B2 7/2003 Griffin et al.
6,592,985 B2 7/2003 Griffin et al.
6,601,661 B2 8/2003 Baker et al.
6,601,662 B2 8/2003 Matthias et al.
6,637,528 B2 10/2003 Nishiyama et al.
6,684,966 B2 2/2004 Lin et al.
6,684,967 B2 2/2004 Mensa-Wilmot et al.
6,729,418 B2 5/2004 Slaughter, Jr. et al.
6,739,214 B2 5/2004 Griffin et al.
6,742,607 B2 6/2004 Beaton
6,745,858 B1 6/2004 Estes
6,749,033 B2 6/2004 Griffin et al.
6,797,326 B2 9/2004 Griffin et al.
6,823,951 B2 11/2004 Yong et al.
6,843,333 B2 1/2005 Richert et al.
6,861,098 B2 3/2005 Griffin et al.
6,861,137 B2 3/2005 Griffin et al.
6,878,447 B2 4/2005 Griffin et al.
6,883,623 B2 4/2005 McCormick et al.
6,902,014 B1 6/2005 Estes
6,922,925 B2 8/2005 Watanabe et al.
6,986,395 B2 1/2006 Chen
6,988,569 B2 1/2006 Lockstedt et al.
7,096,978 B2 8/2006 Dykstra et al.
7,111,694 B2 9/2006 Beaton
7,128,173 B2 10/2006 Lin
7,137,460 B2 11/2006 Slaughter, Jr. et al.
7,152,702 B1 12/2006 Bhome et al.
7,197,806 B2 4/2007 Boudreaux et al.
7,198,119 B1 4/2007 Hall et al.
7,234,549 B2 6/2007 McDonough et al.
7,234,550 B2 6/2007 Azar et al.
7,270,196 B2 9/2007 Hall
7,281,592 B2 10/2007 Runia et al.
7,292,967 B2 11/2007 McDonough et al.
7,311,159 B2 12/2007 Lin et al.
7,320,375 B2 1/2008 Singh
7,341,119 B2 3/2008 Singh
7,350,568 B2 4/2008 Mandal et al.
7,350,601 B2 4/2008 Belnap et al.
7,360,612 B2 4/2008 Chen et al.
7,377,341 B2 5/2008 Middlemiss et al.
7,387,177 B2 6/2008 Zahradnik et al.
7,392,862 B2 7/2008 Zahradnik et al.
7,398,837 B2 7/2008 Hall et al.
7,416,036 B2 8/2008 Forstner et al.
7,435,478 B2 10/2008 Keshavan
7,458,430 B2 12/2008 Fyfe
7,462,003 B2 12/2008 Middlemiss
7,473,287 B2 1/2009 Belnap et al.
7,493,973 B2 2/2009 Keshavan et al.
7,517,589 B2 4/2009 Eyre
7,533,740 B2 5/2009 Zhang et al.
7,559,695 B2 7/2009 Sexton et al.
7,568,534 B2 8/2009 Griffin et al.
7,621,346 B1 11/2009 Trinh et al.
7,621,348 B2 11/2009 Hoffmaster et al.
7,647,991 B2 1/2010 Felderhoff
7,703,556 B2 4/2010 Smith et al.
7,703,557 B2 4/2010 Durairajan et al.
7,819,208 B2 10/2010 Pessier et al.
7,836,975 B2 11/2010 Chen et al.
7,845,435 B2 12/2010 Zahradnik et al.
7,845,437 B2 12/2010 Bielawa et al.
7,847,437 B2 12/2010 Chakrabarti et al.
7,992,658 B2 8/2011 Buske
8,028,769 B2 10/2011 Pessier et al.
8,056,651 B2 11/2011 Turner
8,177,000 B2 5/2012 Bhome et al.
8,201,646 B2 6/2012 Vezirian
8,302,709 B2 11/2012 Bhome et al.
8,356,398 B2 1/2013 McCormick et al.
8,950,514 B2 2/2015 Buske
2001/0000885 A1 5/2001 Beuershausen et al.
2001/0030066 A1 10/2001 Clydesdale et al.
2002/0092684 A1 7/2002 Singh et al.
2002/0100618 A1 8/2002 Watson et al.
2002/0108785 A1 8/2002 Slaughter, Jr. et al.
2004/0031625 A1 2/2004 Lin et al.
2004/0099448 A1 5/2004 Fielder et al.
2004/0238224 A1 12/2004 Runia
2005/0087370 A1 4/2005 Ledgerwood, III et al.
2005/0103533 A1 5/2005 Sherwood, Jr. et al.
2005/0167161 A1 8/2005 Aaron
2005/0178587 A1 8/2005 Witman, IV et al.
2005/0183892 A1 8/2005 Oldham et al.
2005/0252691 A1 11/2005 Bramlett et al.
2005/0263328 A1 12/2005 Middlemiss
2005/0273301 A1 12/2005 Huang
2006/0027401 A1 2/2006 Nguyen
2006/0032674 A1 2/2006 Chen et al.
2006/0032677 A1 2/2006 Azar et al.
2006/0162969 A1 7/2006 Belnap et al.
2006/0196699 A1 9/2006 Estes et al.
2006/0254830 A1 11/2006 Radtke
2006/0266558 A1 11/2006 Middlemiss et al.
2006/0266559 A1 11/2006 Keeshavan et al.
2006/0283640 A1 12/2006 Estes et al.

(56) References Cited

U.S. PATENT DOCUMENTS

| | | | |
|---|---|---|---|
| 2007/0029114 | A1 | 2/2007 | Middlemiss |
| 2007/0034414 | A1 | 2/2007 | Singh et al. |
| 2007/0046119 | A1 | 3/2007 | Cooley |
| 2007/0062736 | A1 | 3/2007 | Cariveau et al. |
| 2007/0079994 | A1 | 4/2007 | Middlemiss |
| 2007/0084640 | A1 | 4/2007 | Singh |
| 2007/0131457 | A1 | 6/2007 | McDonough et al. |
| 2007/0187155 | A1 | 8/2007 | Middlemiss |
| 2007/0221417 | A1 | 9/2007 | Hall et al. |
| 2007/0227781 | A1 | 10/2007 | Cepeda et al. |
| 2007/0272445 | A1 | 11/2007 | Cariveau |
| 2008/0028891 | A1 | 2/2008 | Calnan et al. |
| 2008/0029308 | A1 | 2/2008 | Chen |
| 2008/0066970 | A1 | 3/2008 | Zahradnik et al. |
| 2008/0087471 | A1 | 4/2008 | Chen et al. |
| 2008/0093128 | A1 | 4/2008 | Zahradnik et al. |
| 2008/0156543 | A1 | 7/2008 | McDonough et al. |
| 2008/0164069 | A1 | 7/2008 | McDonough et al. |
| 2008/0264695 | A1 | 10/2008 | Zahradnik et al. |
| 2008/0296068 | A1 | 12/2008 | Zahradnik et al. |
| 2008/0308320 | A1 | 12/2008 | Kolachalam |
| 2009/0044984 | A1 | 2/2009 | Massey et al. |
| 2009/0114454 | A1 | 5/2009 | Belnap et al. |
| 2009/0120693 | A1 | 5/2009 | McClain et al. |
| 2009/0126998 | A1 | 5/2009 | Zahradnik et al. |
| 2009/0159338 | A1 | 6/2009 | Buske |
| 2009/0159341 | A1 | 6/2009 | Pessier et al. |
| 2009/0166093 | A1 | 7/2009 | Pessier et al. |
| 2009/0178855 | A1 | 7/2009 | Zhang et al. |
| 2009/0178856 | A1 | 7/2009 | Singh et al. |
| 2009/0183925 | A1 | 7/2009 | Zhang et al. |
| 2009/0236147 | A1 | 9/2009 | Koltermann et al. |
| 2009/0272582 | A1 | 11/2009 | McCormick et al. |
| 2009/0283332 | A1 | 11/2009 | Dick et al. |
| 2010/0012392 | A1 | 1/2010 | Zahradnik et al. |
| 2010/0018777 | A1 | 1/2010 | Pessier et al. |
| 2010/0043412 | A1 | 2/2010 | Dickinson et al. |
| 2010/0155146 | A1 | 6/2010 | Nguyen et al. |
| 2010/0224417 | A1 | 9/2010 | Zahradnik et al. |
| 2010/0252326 | A1 | 10/2010 | Bhome et al. |
| 2010/0276205 | A1 | 11/2010 | Oxford et al. |
| 2010/0288561 | A1 | 11/2010 | Zahradnik et al. |
| 2010/0319993 | A1 | 12/2010 | Bhome et al. |
| 2010/0320001 | A1 | 12/2010 | Kulkarni |
| 2011/0024197 | A1 | 2/2011 | Centala et al. |
| 2011/0079440 | A1 | 4/2011 | Buske et al. |
| 2011/0079441 | A1 | 4/2011 | Buske et al. |
| 2011/0079442 | A1 | 4/2011 | Buske et al. |
| 2011/0079443 | A1 | 4/2011 | Buske et al. |
| 2011/0085877 | A1 | 4/2011 | Osborne, Jr. |
| 2011/0162893 | A1 | 7/2011 | Zhang |
| 2012/0111638 | A1 | 5/2012 | Nguyen et al. |
| 2012/0205160 | A1 | 8/2012 | Ricks et al. |
| 2015/0152687 | A1 | 6/2015 | Nguyen et al. |
| 2015/0197992 | A1 | 7/2015 | Ricks et al. |

FOREIGN PATENT DOCUMENTS

| | | |
|---|---|---|
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| GB | 2194571 | 3/1988 |
| GB | 2364340 | 1/2002 |
| GB | 2403313 | 12/2004 |
| JP | 2001-159289 | 6/2001 |
| JP | 2001159289 | 6/2001 |
| RU | 1331988 | 8/1987 |
| WO | 8502223 | 5/1985 |
| WO | 2008124572 | 10/2008 |
| WO | 2009135119 | 11/2009 |
| WO | 2010127382 | 11/2010 |
| WO | 2010135605 | 11/2010 |
| WO | 2015102891 | 7/2015 |

OTHER PUBLICATIONS

Becamel, International Preliminary Report on Patentability for the International Patent Application No. PCT/US2010/039100, The International Bureau of WIPO, Switzerland, dated Jan. 5, 2012.

Beijer, International Preliminary Report on Patentability for International Patent Application No. PCT/US2009/042514 The International Bureau of WIPO, dated Nov. 2, 2010.

Buske, et al., "Performance Paradigm Shift: Drilling Vertical and Directional Sections Through Abrasive Formations with Roller Cone Bits", Society of Petroleum Engineers—SPE 114975 CIPC/SPE Gas Technology Symposium 2008 Joint Conference Canada, dated Jun. 16-19, 2008.

Choi, International Search Report for International Patent Application No. PCT/US2010/0039100, Korean Intellectual Property Office, dated Jan. 25, 2011.

Choi, Written Opinion for International Patent Application No. PCT/US2010/039100, Korean Intellectual Property Office, dated Jan. 25, 2011.

Dr. Wells, et al., "Bit Balling Mitigation in PDC Bit Design", International Association of Drilling Contractors/ Society of Petroleum Engineers—IADC/SPE 114673 IADC/SPE Asia Pacific Drilling Technology Conference and Exhibition Indonesia, dated Aug. 25-27, 2008.

Ersoy, et al., "Wear characteristics of PDC pin and hybrid core bits in rock drilling", Wear 188 Elsevier Science S.A., pp. 150-165, dated Mar. 1995.

George, et al., "Significant Cost Savings Achieved Through Out the Use of PDC Bits in Compressed Air/Foam Applications", Society of Petroleum Engineers—SPE 116118 2008 SPE Annual Technical Conference and Exhibition Denver, Colorado, dated Sep. 21-24, 2008.

Georgescu, Written Opinion for International Patent Application No. PCT/US2010/051020, European Patent Office dated Jun. 1, 2011.

Georgescu, International Search Report for International Patent Application No. PCT/US2010/050631, European Patent Office dated Jun. 10, 2011.

Georgescu, Written Opinion for International Patent Application No. PCT/US2010/050631, European Patent Office dated Jun. 10, 2011.

Georgescu, International Search Report for International Patent Application No. PCT/US2011/042437, European Patent Office dated Nov. 9, 2011.

Georgescu, Written Opinion for International Patent Application No. PCT/US2011/042437, European Patent Office dated Nov. 9, 2011.

Georgescu, International Search Report for International Patent Application No. PCT/US2010/051020, European Patent Office, dated Jun. 1, 2011.

Georgescu, International Search Report for International Patent Application No. PCT/US2010/051019, European Patent Office, dated Jun. 6, 2011.

Georgescu, Written Opinion for International Patent Application No. PCT/US2010/051019, European Patent Office, dated Jun. 6, 2011.

Georgescu, International Search Report for International Patent Application No. PCT/US2010/051017, European Patent Office, dated Jun. 8, 2011.

Georgescu, Written Opinion for International Patent Application No. PCT/US2010/051017, European Patent Office, dated Jun. 8, 2011.

Georgescu, International Search Report for International Patent Application No. PCT/US2010/051014, European Patent Office dated Jun. 9, 2011.

Georgescu, Written Opinion for International Patent Application No. PCT/US2010/051014, European Patent Office, dated Jun. 9, 2011.

Kang, International Search Report for International Patent Application No. PCT/US2010/033513, Korean Intellectual Property Office, dated Jan. 10, 2011.

(56) References Cited

OTHER PUBLICATIONS

Kang, Written Opinion for International Patent Application No. PCT/US2010/033513, Korean Intellectual Property Office, dated Jan. 10, 2011.
Kang, International Search Report for International Patent Application No. PCT/US2010/032511, Korean Intellectual Property Office, dated Jan. 17, 2011.
Kang, Written Opinion for International Patent Application No. PCT/US2010/032511, Korean Intellectual Property Office, dated Jan. 17, 2011.
Kim, International Search Report for International Patent Application No. PCT/US2009/067969, Korean Intellectual Property Office, dated May 25, 2010.
Kim, Written Opinion for International Patent Application No. PCT/US2009/067969, Korean Intellectual Property Office, dated May 25, 2010.
Lee, International Search Report for International Patent Application No. PCT/US2009/042514, Korean Intellectual Property Office dated Nov. 27, 2009.
Lee, Written Opinion for International Patent Application No. PCT/US2009/042514, Korean Intellectual Property Office dated Nov. 27, 2009.
Williams, et al., "An Analysis of the Performance of PDC Hybrid Drill Bits", SPE/IADC 16117, SPE/IADC Drilling Conference, pp. 585-594, dated Mar. 1987.
Lee, International Search Report for International Patent Application No. PCT/US2009/050672, Korean Intellectual Property Office dated Mar. 3, 2010.
Warren, et al., "PDC Bits: What's Needed to Meet Tomorrow's Challenge", SPE 27978, University of Tulsa Centennial Petroleum Engineering Symposium, pp. 207-214, dated Aug. 1994.
Lee, Written Opinion for International Patent Application No. PCT/US2009/050672, Korean Intellectual Property Office dated Mar. 3, 2010.
Tomlinson, et al., "Rock Drilling—Syndax3 Pins—New Concepts in PCD Drilling", Industrial Diamond Review, pp. 109-114, dated Mar. 1992.
Mills Machine Company, "Rotary Hole Openers—Section 8", Retrieved from the internet on May 7, 2009 using <URL: http://www.millsmachine.com/pages/home_page/mills_catalog/cat_holeopen/cat_holeopen.pdf>.
Ott, International Search Report for International Patent Application No. PCT/US2010/049159, European Patent Office, dated Apr. 21, 2011.
Ott, Written Opinion for International Patent Application No. PCT/US2010/049159, European Patent Office, dated Apr. 21, 2011.
Smith Services, "Hole Opener—Model 6980 Hole Opener", Retrieved from the internet on May 7, 2008 using <URL: http://www.siismithservices.com/b_products/product_page.asp?ID=589>.
Pessier, et al., "Hybrid Bits Offer Distinct Advantages in Selected Roller Cone and PDC Bit Applications", IADC/SPE Paper No. 128741, dated Feb. 2-4, 2010, pp. 1-9.
Schneiderbauer, International Search Report for International Patent Application No. PCT/US2012/024134, European Patent Office, dated Mar. 7, 2013.
Schneiderbauer, International Written Opinion for International Patent Application No. PCT/US2012/024134, European Patent Office, dated Mar. 7, 2013.
Schouten, International Search Report for International Patent Application No. PCT/US2008/083532 European Patent Office, dated Feb. 25, 2009.
Schouten, Written Opinion for International Patent Application No. PCT/US2008/083532, European Patent Office dated Feb. 25, 2009.
Sheppard, et al., "Rock Drilling—Hybrid Bit Success for Syndax3 Pins", Industrial Diamond Review, pp. 309-311, dated Jun. 1993.
Thomas, S., International Search Report for International Patent Application No. PCT/US2015/014011, USPTO, dated Apr. 24, 2015.
Thomas, S., Written Opinion for International Patent Application No. PCT/US2015/014011, USPTO, dated Apr. 24, 2015.
Dantinne, P, International Search Report for International Patent Application No. PCT/US2015/032230, European Patent Office, dated Nov. 16, 2015.
Dantinne, P, Written Opinion for International Patent Application No. PCT/US2015/032230, European Patent Office, dated Nov. 16, 2015.

* cited by examiner

EXTERNAL, DIVORCED PDC BEARING ASSEMBLIES FOR HYBRID DRILL BITS

CROSS-REFERENCE TO RELATED APPLICATIONS

This application is a continuation of U.S. patent application Ser. No. 12/883,900, filed Sep. 16, 2010, now U.S. Pat. No. 9,004,198, issued Apr. 14, 2015, which claims the benefit of and priority to U.S. Provisional Patent Application Ser. No. 61/243,048, filed Sep. 16, 2009, the contents of each of which are incorporated herein by this reference in their entirety.

BACKGROUND OF THE INVENTION

Field of the Invention

The inventions disclosed and taught herein relate generally to drill bits for use in drilling operations in subterranean formations. More particularly, the disclosure relates to hybrid drill bits, and apparatus and methods for increasing the strength and extending the wear life of the support surfaces and bearing elements in such drill bits.

Description of the Related Art

Drill bits are frequently used in the oil and gas exploration and the recovery industry to drill well bores (also referred to as "boreholes") in subterranean earth formations. There are two common classifications of drill bits used in drilling well bores that are known in the art as "fixed blade" drill bits and "roller cone" drill bits. Fixed blade drill bits include polycrystalline diamond compact (PDC) and other drag-type drill bits. These drill bits typically include a bit body having an externally threaded connection at one end for connection to a drill string, and a plurality of cutting blades extending from the opposite end of the bit body. The cutting blades form the cutting surface of the drill bit. Often, a plurality of cutting elements, such as PDC cutters or other materials, which are hard and strong enough to deform and/or cut through earth formations, are attached to or inserted into the blades of the bit, extending from the bit and forming the cutting profile of the bit. This plurality of cutting elements is used to cut through the subterranean formation during drilling operations when the drill bit is rotated by a motor or other rotational input device.

The other type of earth boring drill bit, referred to as a roller cone bit, developed out of the fishtail bit in the early 1900's as a durable tool for drilling hard and abrasive formations. The roller cone type of drill bit typically includes a bit body with an externally threaded connection at one end, and a plurality of roller cones (typically three) attached at an offset angle to the other end of the drill bit. These roller cones are able to rotate about bearings, and rotate individually with respect to the bit body.

More recently, a new type of earth boring drill bit that has made a presence in the drilling arena is the so-called "hybrid" drill bit, which combines both fixed cutting blades and rolling cones on its working face. The hybrid drill bit is designed to overcome some of the limiting phenomena of roller cone and fixed-cutter PDC bits alone, such as balling, reducing drilling efficiency, tracking, and wear problems. While PDC bits have replaced roller cone bits in all but some applications for which the roller cone bits are uniquely suited, such as hard, abrasive, and interbedded formations, complex directional drilling applications, and applications involving high torque requirements, it is in these applications where the hybrid bit can substantially enhance the performance of a roller cone bit with a lower level of harmful dynamics compared to a conventional PDC bit. Some of these hybrid drill bits have been described, for instance, in U.S. Patent Publication Nos. 2008/0264695 and 2009/0126998, and in IADC/SPE Paper No. 128741 ("Hybrid Bits Offer Distinct Advantages in Selected Roller Cone and PDC Bit Applications," R. Pessier and M. Damschen, 2010).

Regardless of the type of drill bit used, earth boring drilling operations occur under harsh and brutal conditions, often in the presence of extreme pressures, temperatures, and sometimes even hostile chemical environments. Further, the bits are subjected to extremely demanding mechanical stress during operation, such as high-impact forces, high loads on the drill bit associated with faster rotation speeds and increased penetration rates, and the like. Of the numerous components of the drill bits that suffer under these conditions, particularly in the case of bits having one or more roller cone type bits, the bearings in the drill bit can be particularly vulnerable, with their failure resulting in bit malfunction and premature bit removal from the well bore, which in turn results in lost time and drilling progress. Consequently, much effort has been devoted over the years to improving the wear, impact resistance, and load capacity of bearings and bearing assemblies for use in earth-boring drill bits.

For example, U.S. Pat. No. 4,260,203 describes a rotary rock bit having bearing surfaces utilized therein which have extremely long wear resistant properties. The rock bit comprises a plurality of legs extending downwardly from a main bit body. A cone cutter is rotatively mounted on a journal formed on each leg. One or more of the inter-engaging bearing surfaces between the cone and the journal includes a layer of diamond material mounted on a substrate of carbide. In one embodiment, the bearing material forms the thrust button adjacent the spindle located at the end of the journal. In another embodiment, the bearing material is located on the inter-engaging axial faces of the journal and cone. In still another embodiment, the bearing material is a segmented cylindrical bearing located in a circumferential groove formed in the journal.

In U.S. Pat. No. 4,729,440 to Hall, an earth boring apparatus is disclosed, the apparatus having bearing members comprised of transition layer polycrystalline diamond. The transition layer polycrystalline diamond bearings include a polycrystalline diamond layer interfaced with a composite transition layer comprising a mixture of diamond crystals and precemented carbide pieces subjected to high temperature/high pressure conditions so as to form polycrystalline diamond material bonded to the precemented carbide pieces. The polycrystalline diamond layer acts as the bearing surface. The transition layer bearings are preferably supported by a cemented tungsten carbide substrate interfaced with the transition layer.

In U.S. Pat. No. 4,802,539, also to Hall, a roller cone rock bit is disclosed with an "improved bearing system." The improvement reportedly comprises a main journal bearing which is substantially frustoconically (or cone) shaped and a main roller cone bearing which is reverse-shaped so as to be able to mate with the journal bearing. The journal and roller cone bearings comprise polycrystalline diamond. The invention also describes a member for retaining the roller cone on the journal, as appropriate.

Despite these proposed approaches, they often have suffered from material deficiencies, machining difficulties, or the like, leaving the need for improved bearing systems for use with roller cone drill bits. The inventions disclosed and taught herein are directed to drill bits, including, but not limited to, hybrid-type drill bits, having an improved bearing system for use with the roller cones on the drill bit.

BRIEF SUMMARY OF THE INVENTION

Described herein are improved bearing assemblies for use with earth boring drill bits having at least one roller cone, in particular for use with hybrid drill bits comprising both fixed cutting means and rotary cutting means. In accordance with several aspects of the disclosure, the improved bearing assemblies include divorced bearing assemblies that are attachable to the bit leg spindle and which are more readily replaceable after wear than current bearing designs.

In accordance with a first aspect of the present disclosure, a drill bit is described, the drill bit comprising a bit body having an axis, an axial center, and at least one fixed blade extending in the axial direction downwardly from the bit body; at least one rolling cutter mounted to the bit body; at least one rolling-cutter cutting element arranged on the rolling cutter and radially spaced apart from the axial center; a plurality of fixed cutting elements arranged on the fixed blades and at least one of the fixed cutting elements is located near an axial center of the bit body and adapted to cut formation at the axial center; and a bearing assembly as described and shown in detail herein. In further accordance with this aspect of the disclosure, the bearing assembly may comprise a plurality of PDC bearing elements.

In accordance with a further aspect of the present disclosure, a hybrid drill bit for use in drilling through subterranean formations is described, the hybrid drill bit comprising a shank disposed about a longitudinal centerline and adapted to be coupled to a drill string; at least one fixed blade extending from the shank, the fixed blade comprising at least one cutting element extending from a surface of the fixed blade; a bearing assembly as described herein; and at least two rolling cutter legs extending downwardly from the shank, the legs comprising a cantilevered bearing shaft extending inwardly and downwardly and having an axis of rotation, the spindle comprising: at least two rolling cutters mounted for rotation on the bearing shaft, adapted to rotate about the axis of rotation on the journal and pilot pin, the rolling cutters comprising a plurality of cutting elements extending from an external surface of the rolling cutter. In further accordance with this aspect of the present disclosure, the bearing assembly may include a plurality of PDC bearing elements affixed to sleeves circumscribing the journal and pilot pins.

In yet further aspects of the present disclosure, a method of drilling a subterranean formation is described wherein the method comprises rotating a drill bit against a formation under applied weight on bit; drilling a central cone region and a gage region of a borehole using only fixed cutting elements; and, drilling another portion of the borehole extending radially between the cone region and the gage portion using both fixed and movable cutting elements, wherein the drill bit is a rolling cone or hybrid drill bit as described herein having a bearing assembly, which includes a plurality of PDC, shaped bearing elements on at least a portion of at least one of the spindle sections of the drill bit.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
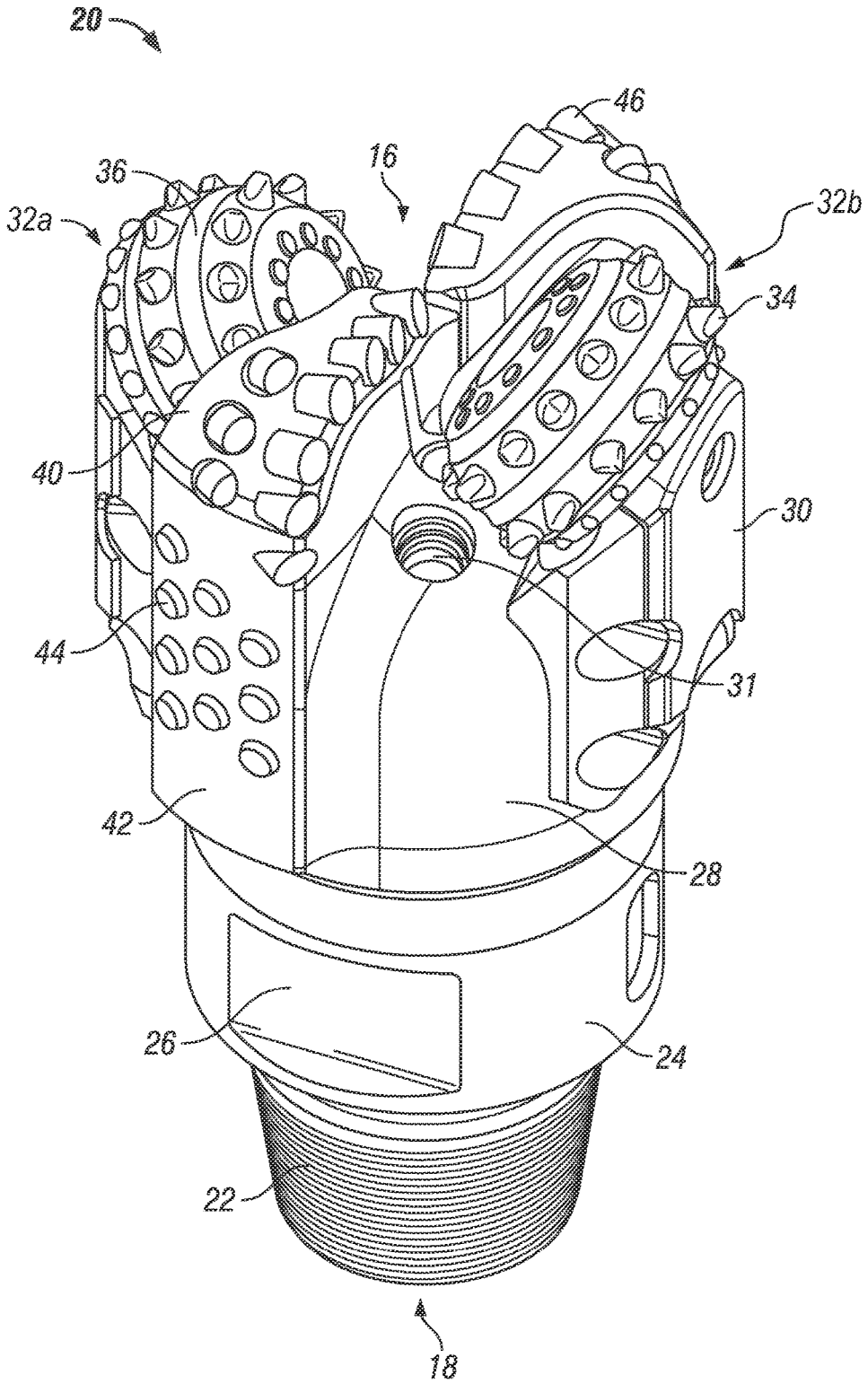
FIG. 1 illustrates a perspective view of an exemplary hybrid drill bit in accordance with the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DEFINITIONS

The following definitions are provided in order to aid those skilled in the art in understanding the detailed description of the present invention.

The term "cone assembly" as used herein includes various types and shapes of roller cone assemblies and cutter cone assemblies rotatably mounted to a support arm. Cone assemblies may also be referred to equivalently as "roller cones" or "cutter cones." Cone assemblies may have a generally conical exterior shape or may have a more rounded exterior shape. Cone assemblies associated with roller cone drill bits generally point inwards towards each other or at least in the direction of the axial center of the drill bit. For some applications, such as roller cone drill bits having only one cone assembly, the cone assembly may have an exterior shape approaching a generally spherical configuration.

The term "cutting element" as used herein includes various types of compacts, inserts, milled teeth and welded compacts suitable for use with roller cone drill bits. The terms "cutting structure" and "cutting structures" may equivalently be used in this application to include various combinations and arrangements of cutting elements formed on or attached to one or more cone assemblies of a roller cone drill bit.

The term "bearing structure", as used herein, includes any suitable bearing, bearing system and/or supporting structure satisfactory for rotatably mounting a cone assembly on a support arm. For example, a "bearing structure" may include inner and outer races and bushing elements to form a journal bearing, a roller bearing (including, but not limited to, a roller-ball-roller-roller bearing, a roller-ball-roller bearing, and a roller-ball-friction bearing) or a wide variety of solid bearings. Additionally, a bearing structure may include interface elements such as bushings, rollers, balls, and areas of hardened materials used for rotatably mounting a cone assembly with a support arm.

The term "spindle" as used in this application includes any suitable journal, shaft, bearing pin, structure or combination of structures suitable for use in rotatably mounting a cone assembly on a support arm. In accordance with the instant disclosure, one or more bearing structures may be disposed between adjacent portions of a cone assembly and a spindle to allow rotation of the cone assembly relative to the spindle and associated support arm.

The term "fluid seal" may be used in this application to include any type of seal, seal ring, backup ring, elastomeric seal, seal assembly or any other component satisfactory for forming a fluid barrier between adjacent portions of a cone assembly and an associated spindle. Examples of fluid seals typically associated with roller cone drill bits and suitable for use with the inventive aspects described herein include, but are not limited to, O-rings, packing rings, and metal-to-metal seals.

The term "roller cone drill bit" may be used in this application to describe any type of drill bit having at least one support arm with a cone assembly rotatably mounted thereon. Roller cone drill bits may sometimes be described as "rotary cone drill bits," "cutter cone drill bits" or "rotary rock bits". Roller cone drill bits often include a bit body with three support arms extending therefrom and a respective cone assembly rotatably mounted on each support arm. Such drill bits may also be described as "tri-cone drill bits". However, teachings of the present disclosure may be satisfactorily used with drill bits including, but not limited to, hybrid drill bits, having one support arm, two support arms or any other number of support arms and associated cone assemblies.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. The terms "couple," "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and may further include without limitation integrally forming one functional member with another in a unity fashion. The coupling may occur in any direction, including rotationally.

Applicants have created improved drill bits, including hybrid drill bits and their associated bearing elements within the body of the associated rolling cutters, where the drill bit, particularly the hybrid drill bit includes at least one, and typically at least two rolling cutters, each rotatable around separate spindles on the bit, and at least one fixed cutting blade. These bits include bearing members that further include a plurality of polycrystalline diamond elements, such as spindles that further include a PDC bearing or bearing sleeve assembly, which may be an external divorced bearing as appropriate.

Figure 2:
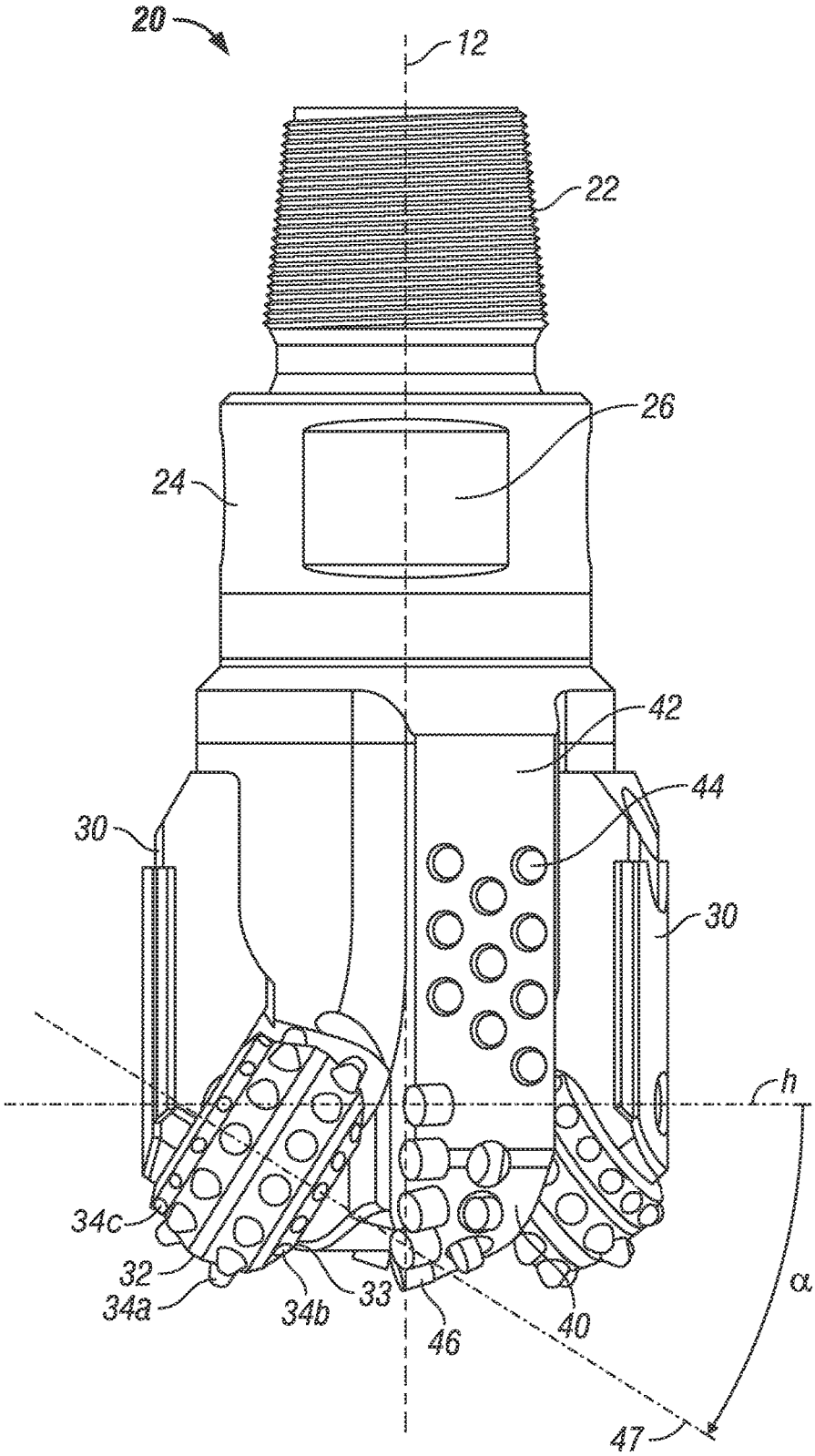
FIG. 2 illustrates an exemplary side view of the hybrid drill bit of FIG. 1.
Figure 3:
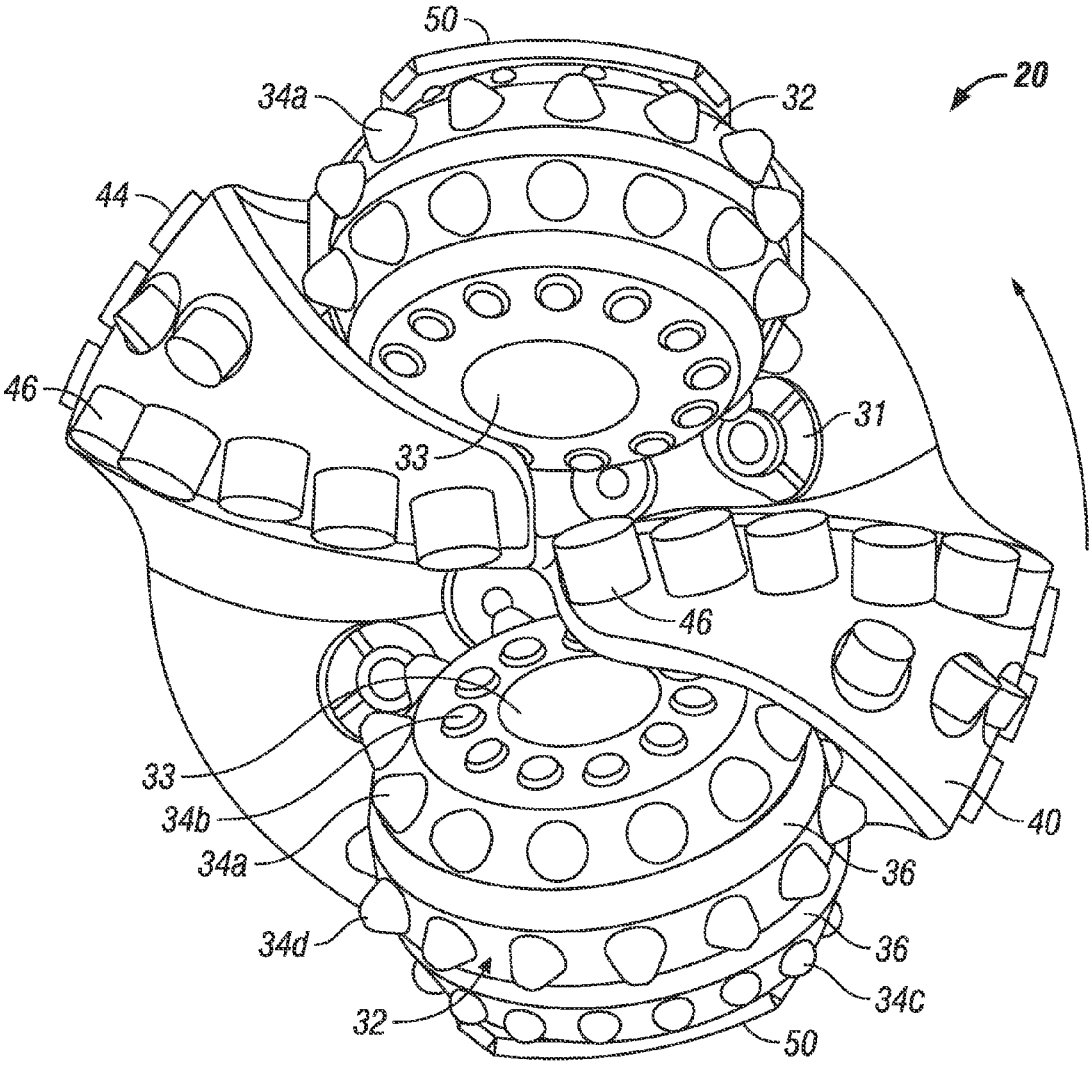
FIG. 3 illustrates an exemplary bottom view of the hybrid drill bit of FIG. 1.

Turning now to the figures in detail, FIG. 1 is an illustration of a perspective view of an exemplary hybrid drill bit 20 in accordance with the present disclosure. FIG. 2 illustrates a side-view of bit of FIG. 1, while FIG. 3 illustrates a bottom view of the exemplary hybrid type drill bit of FIG. 1. These figures will be described in conjunction with each other.

Hybrid earth-boring drill bit 20 has a bit body 28 intermediate between an upper end 18 and a spaced apart, opposite working end 16. The body of the bit also comprises one or more (two are shown) bit legs 30 extending in the axial direction towards working end 16, and comprising what is sometimes referred to as the "shirt-tail region" 50 depending axially downward toward the working end 16 of the bit 20. First and second cutter cones 32*a*, 32*b* (respectively) are rotatably mounted to each of the bit legs 30, in accordance with methods of the present disclosure as will be detailed herein. Bit body 28 also includes a plurality (e.g., two or more) fixed cutting blades 40 extending axially downward toward the working end 16 of bit 20. As also shown in FIG. 1, the working end 16 of drill bit 20 is mounted on a drill bit shank 24 which provides a threaded connection 22 at its upper end 18 for connection to a drill string, drill motor or other bottom hole assembly in a manner well known to those in the drilling industry. The drill bit shank 24 also provides a longitudinal passage within the bit 20 (not shown) to allow fluid communication of drilling fluid through jetting passages and through standard jetting nozzles (not shown) to be discharged or jetted against the well bore and bore face through nozzle ports 31 adjacent the drill bit cutter body 28 during bit operation. A lubricant reservoir supplies lubricant to the bearing spaces of each of the cones 32, and a pressure compensator acts to equalize the lubricant pressure with the borehole fluid pressure on the exterior.

The drill bit shank 24 also provides a bit breaker slot 26, a groove formed on opposing lateral sides of the bit shank 24 to provide cooperating surfaces for a bit breaker slot in a manner well known in the industry to permit engagement and disengagement of the drill bit 20 with the drill string (DS) assembly.

FIG. 2 illustrates a side view of the hybrid drill bit 20 of FIG. 1. Hybrid drill bit 20 has a longitudinal centerline 12 that defines an axial center of the hybrid drill bit. A shank 24 is formed on one end of the hybrid drill bit 20 and is designed to be coupled to a drill string of tubular material (not shown) with threads according to standards promulgated for example by the American Petroleum Institute (API). As referenced above, bit 20 also includes at least one fixed blade 40 that extends downwardly from the shank 24 relative to a general orientation of the bit 20 inside a borehole. As shown in the figure, the fixed blades 40 may optionally include stabilization, or gage pads 42, which in turn may optionally include a plurality of cutting elements 44, typically referred to as gauge cutters. A plurality of fixed blade cutting elements 46 are arranged and secured to a surface on each of the fixed blades 40, such as at the leading edges of the hybrid drill bit 20 relative to the direction of rotation. Generally, the fixed blade cutting elements 46 comprise a polycrystalline diamond compact (PDC) layer or table on a rotationally leading face of a supporting substrate, such as tungsten carbide or the like, the diamond layer or table providing a cutting face having a cutting edge at a periphery thereof for engaging the formation. This combination of PDC and substrate form the PDC-type cutting elements, which are in turn attached or bonded to cutters, such as cylindrical and stud-type cutters, which are then attached to the external surface of the bit. Fixed-blade cutting elements 46 may be brazed or otherwise secured by way of suitable attachment means in recesses or "pockets" on each fixed blade 40 so that their peripheral or cutting edges on cutting faces are presented to the formation. The term PDC as used herein is used broadly herein and is meant to include other materials, such as thermally stable polycrystalline diamond (TSP) wafers or tables mounted on tungsten carbide or similar substrates, and other, similar super-abrasive or super-hard materials including, but not limited to, cubic boron nitride and diamond-like carbon.

The hybrid drill bit 20 further preferably includes at least two, more preferably three (although more or less may be used, equivalently and as appropriate) rolling cutter legs 30 and rolling cutters 32 coupled to such legs at the distal end, sometimes referred to as the "shirt-tail region" 50, of the rolling cutter leg 30. The rolling cutter legs 30 extend downwardly from the shank 24 relative to a general orientation of the bit 20 inside a borehole. Each of the rolling cutter legs 30 include a spindle 52 (FIG. 5) at the legs' distal end 50. The spindle 52 has an axis of rotation 47 about which the spindle 52 is generally symmetrically formed and the rolling cutter 32 rotates, as described below. The axis of rotation 47 is generally disposed at a pin angle "α" ranging from about 33 degrees to about 39 degrees from a horizontal plane "h" that is perpendicular to the longitudinal centerline 12 of bit 20 and intersects a base of the spindle 52, that is, the region of the junction between the spindle 52 and the roller cone leg 30, generally located proximate to the intersection of the rear face of the roller cone leg 30 and the spindle axis of rotation 47. In at least one embodiment of the present disclosure, the axis of rotation 47 can intersect the longitudinal centerline 12. In other embodiments, the axis of rotation 47 can be skewed to the side of the longitudinal centerline 12 to create a sliding effect on the cutting elements as the rolling cutter 32 rotates around the axis of rotation 47. However, other angles and orientations can be used including a pin angle pointing away from the longitudinal centerline 12.

A rolling cutter 32 is generally coupled to each spindle 52, as will be described in more detail below. The hybrid rolling cutter 32 shown in the figures, and as seen most clearly in FIG. 3, generally has an end 33 that in some embodiments can be truncated or frustoconical, compared to a typical roller cone bit. The rolling cutter 32, regardless of shape, is adapted to rotate around the spindle 52 assembly (shown more clearly in FIG. 5) when the hybrid drill bit 20 is being rotated by the drill string through the shank 24. Generally, the rolling cutter 32 includes a plurality of cutting elements 34*a*, 34*b*, 34*c*, and/or 34*d* attached to or engage in the exterior surface 38 of the rolling cutter 32, and may optionally also include one or more grooves 36 to assist in cone efficiency during operation. In accordance with aspects of the present disclosure, while the cutting elements 34 may be randomly placed or specifically spaced about the exterior surface 38 of the cutter 32, in accordance with one aspect, at least some of the cutting elements, 34*a*, 34*b* are generally arranged on the exterior surface 38 of rolling cutter 32 in a circumferential row thereabout, while others, such as cutting elements 34*d* on the heel region of the cutter 32, may be randomly placed. A minimal distance between the cutting elements will vary according to the application, cutting element size, and bit size, and may vary from rolling cutter to rolling cutter, and/or cutting element to cutting element. The cutting elements can include, but are not limited to, tungsten carbide inserts, secured by interference fit into bores in the surface of the rolling cutter 32, milled- or steel-tooth cutting elements integrally formed with and protruding outwardly from the external surface 38 of the rolling cutter 32 and which may be hard-faced or not, and other types of cutting elements. The cutting elements may also be formed of, or coated with, super-abrasive or super-hard materials such as polycrystalline diamond, cubic boron nitride, and the like. The cutting elements may be chisel-shaped as shown, conical, round/hemispherical, or ovoid, or other shapes and combinations of shapes depending upon the application.

FIG. 3 illustrates a bottom view of the working face 16 of the exemplary hybrid bit of FIG. 1, showing the spatial relationship of the rolling cutters 32 to the fixed cutting blades 40 and the cutting elements 46 mounted thereon. In the hybrid drill bit, the cutting elements 46 of the fixed blade 40 and the cutting elements 34*a*-34*d* of the rolling cutter 32 combine to define a congruent cutting face in the leading portions of the hybrid drill bit profile. The cutting elements 34 of the rolling cutter 32 crush and pre- or partially-fracture subterranean materials in a formation in the highly stressed leading portions during drilling operations, thereby easing the burden on the cutting elements 46 of the fixed blade 40.

Other features of the hybrid drill bit 20, such as back up cutters, wear resistant surfaces, nozzles 31 that are used to direct drilling fluids, junk slots that provide a clearance for cuttings and drilling fluid, and other generally accepted features of a drill bit are deemed within the knowledge of those with ordinary skill in the art and do not need further description.

Having described the general aspects of the hybrid drill bit, the focus returns to the spindle with the journal, pilot pin, and shoulder, and the associated bearing means intermediate between the cone and the spindle assembly to reduce the force of friction and thrust as the cone rotates. The journal, pilot pin, and shoulder are stressed in radial and thrust loading when the hybrid drill bit is used to drill the subterranean formations, and the bearings must be able to withstand the high temperatures that the friction of cone rotation produces without spalling (the flaking off of metal from the bearing surface). It is important to provide a bearing assembly for use with a rotating cone on the drill bit, wherein the bearing assembly has a life that is not premature in relation to the cutting elements on the cone. The bearing assemblies described herein advantageously address these points by exhibiting good wear properties and increased operating life of the cutting structures.

Figure 4:
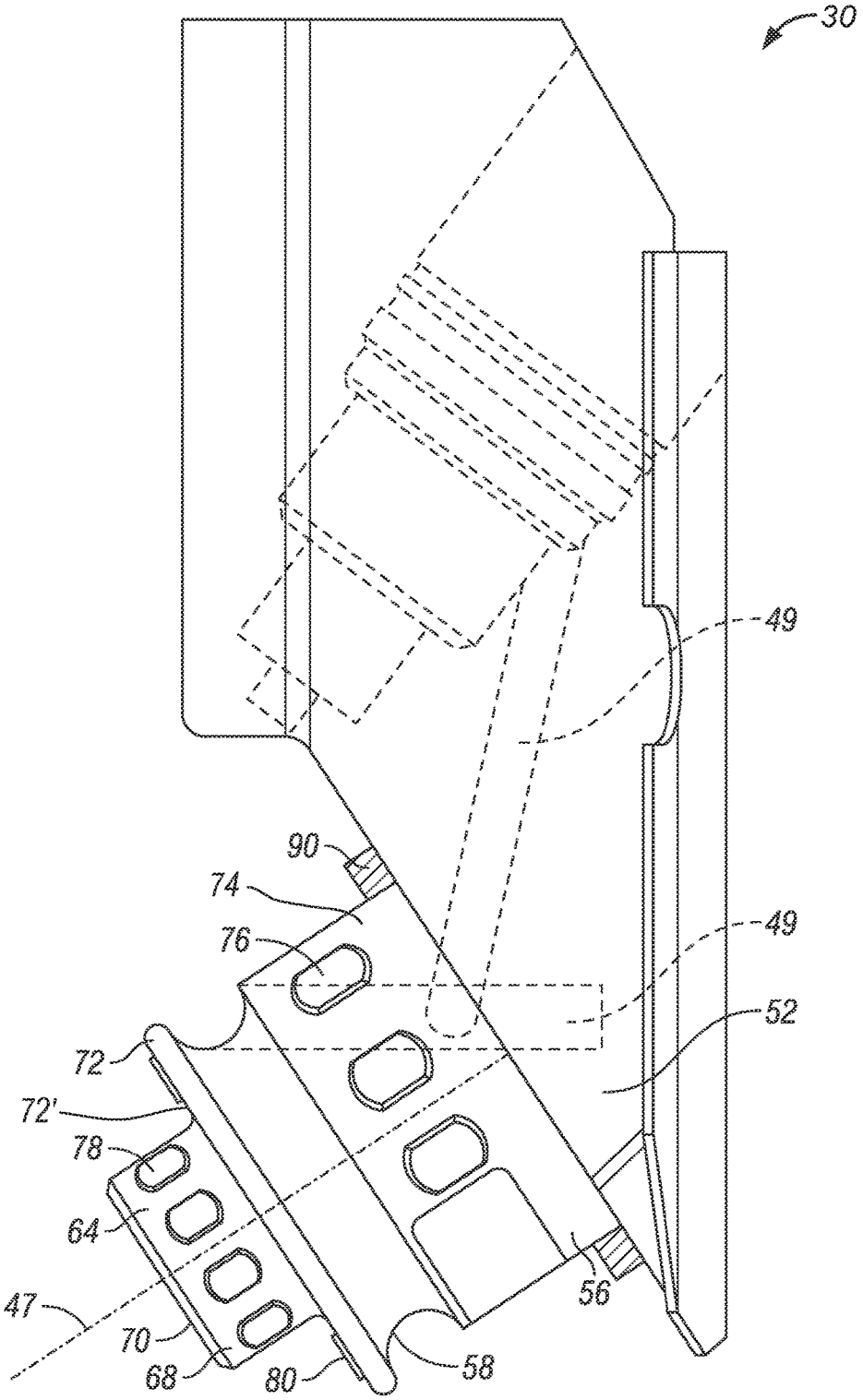
FIG. 4 illustrates a detailed side view of downwardly extending leg of the exemplary hybrid drill bit of FIG. 1 with the rolling cutter cone removed, illustrating an embodiment of the present disclosure.
Figure 5:
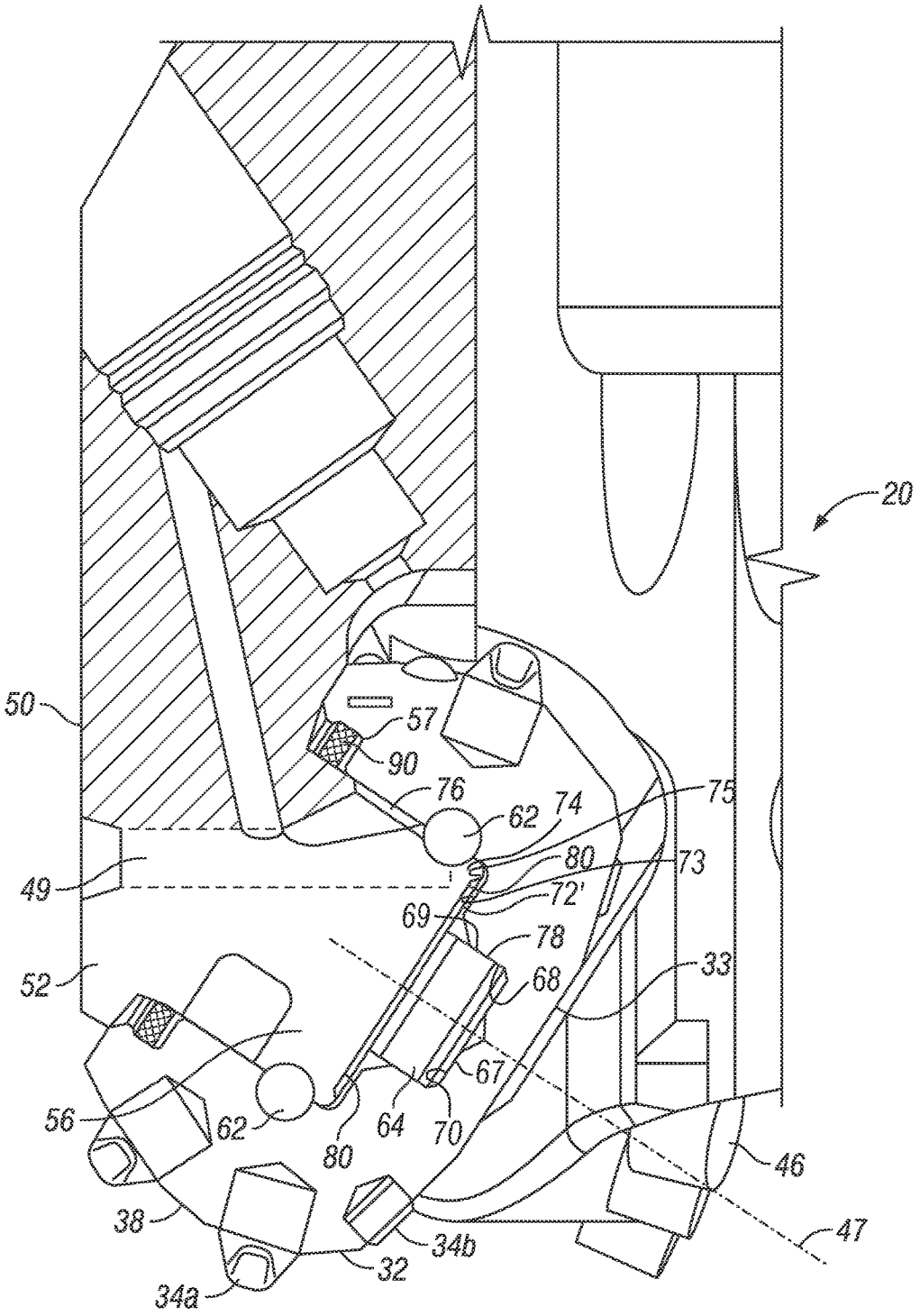
FIG. 5 illustrates a cross-sectional view of a section of the hybrid drill bit of FIG. 1, illustrating an embodiment of the present disclosure.
Figure 6:
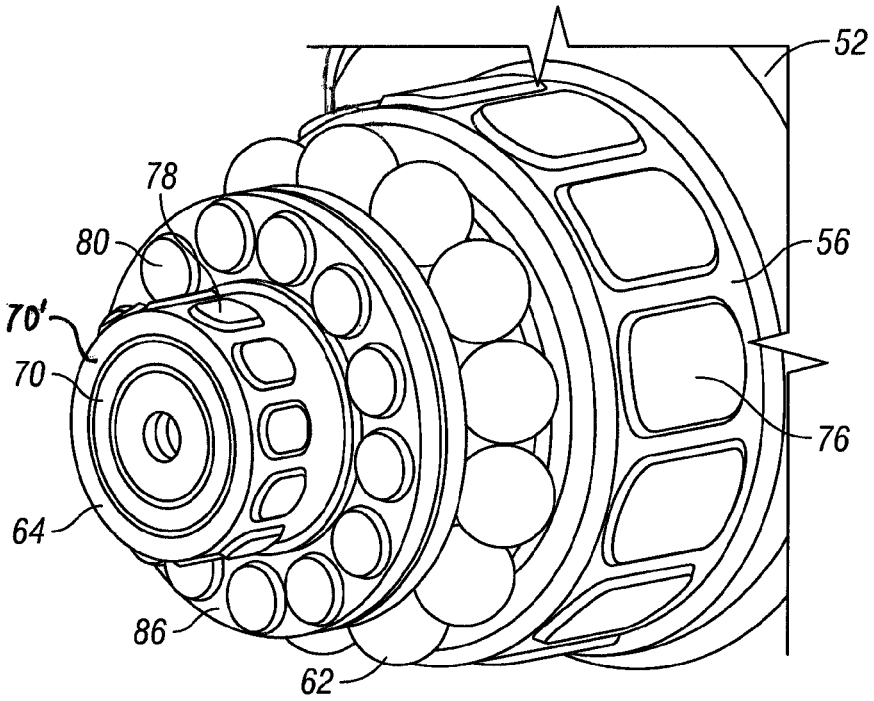
FIG. 6 illustrates a perspective view of a bearing pin in accordance with aspects of the present disclosure, showing PDC bearing elements associated with the bearing pin assembly.
Figure 7:
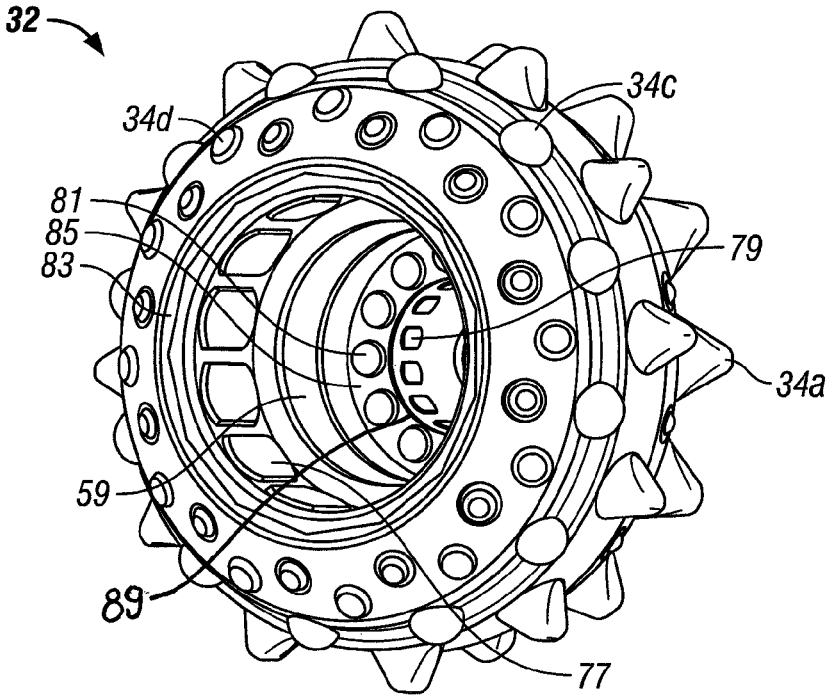
FIG. 7 illustrates a rear perspective view of a hybrid bit cone assembly in accordance with aspects of the present disclosure.

FIG. 4 illustrates a fragmentary sectional view of one of the roller cone legs 30 of hybrid drill bit 20. FIG. 5 illustrates a cross-sectional view of an exemplary roller cone leg, spindle assembly, rolling cone, and a bearing assembly of the present disclosure. FIG. 6 illustrates a perspective view of a bearing pin in accordance with aspects of the present disclosure, showing PDC-type bearing elements associated with the bearing pin assembly. FIG. 7 illustrates a rear perspective view of a hybrid bit cone assembly and associated bearing assemblies in accordance with aspects of the present disclosure. These figures will be described in more detail in conjunction with each other.

Referring now to FIG. 4, one downwardly-extending leg 30 of the hybrid drill bit 20 is shown. The spindle assembly 52 generally forms two portions—a journal pin 56 disposed at the base of the spindle assembly 52 and extending outwardly in the direction of the axis of rotation 47, and a pilot pin 64 adjacent the nose end of journal pin 56 and also extending axially along the axis of rotation 47. A shoulder region 72 is established as a result of the different diameters between the journal pin 56 and the pilot pin 64. The journal pin 56, pilot pin 64, and shoulder region 72 support a rolling cutter 32 rotatably disposed about the journal pin 56 and pilot pin 64. The hybrid cone cutter 32 is rotatively mounted on spindle assembly 52 extending out of the distal end of leg 50. The journal pin 56 includes a ball race 58 which registers with a ball race 59 formed in the cutter 32 for receiving a plurality of ball bearings 62 or equivalent retaining means, such as an annular retaining ring. Besides functioning as a bearing structure, the ball bearings 62 (or equivalent retaining means) also function as a means for retaining the cone 32 on the journal pin 56. While not shown in the figure, one or more retaining flanges may be included in the assembly in order to retain the bearing means in place.

The journal pin 56 also includes a pilot pin 64 formed on the outer extremity of the nose end thereof. The pilot pin 64 includes an axial face 70 and a cylindrical face 68. These pilot pin faces 68 and 70 are adapted to engage the opposed axial and cylindrical faces 67 and 69, respectively, of the cutter 32. In accordance with non-limiting aspects of the present disclosure, a quantity of hardfacing material may be applied to either of the cylindrical surfaces of either the pilot and/or journal pins and/or the cylindrical surfaces on interior regions of the cutter, as may be appropriate.

The journal pin 56 further includes an axial face 72' and a cylindrical face 74 which are adapted to oppose and engage a corresponding axial face 73 and a cylindrical face 75 formed in the cone 32. The above-mentioned interengaging axial and cylindrical surfaces of the journal pin 56 and cutter cone 32 form the bearing surfaces for the friction bearing assemblies of the present disclosure.

As is shown in FIG. 4 and FIG. 5, a lubricant passageway 49 is typically formed in the leg assembly and communicates with a lubricant reservoir (not shown) formed in the upper part of the leg. Although not shown in full detail, the lubricant passageway 49 extends downwardly into the journal pin 56 to communicate with the bearing areas between the interior of cutter cone 32 and journal pin 56. An elastomeric (or equivalent) annular seal 90 may be provided with a channel 57 formed at the base of the cutter cone 32 to prevent the lubricant from passing from the bearing area to the exterior of the rotary rock bit. The seal 90 also functions to prevent drilling fluid or debris from entering from the bit exterior into the bearing area of each leg assembly.

Turning now to FIG. 6, a perspective view of a spindle assembly 52 of the present disclosure, absent the cutter cone 32 and having a bearing assembly in accordance with one aspect of the present disclosure is shown. In addition to the ball bearings 62, which act in both a cone retention capacity to hold the cutter cone on the bearing assembly, and as bearing means themselves, the bearing assembly includes external journal pin sleeve 56' and external pilot pin sleeve member 70', as well as external thrust bearing disc 86 circumscribing shoulder region 72. Each of these bearing members are made of an appropriate metal material, and further comprise a plurality of PDC or diamond bearing elements, such as journal pin bearings 76, pilot pin bearings 78, and thrust bearings 80. The bearing assembly may also include one or more retaining members which circumscribe the appropriate region of the spindle assembly 52 and keep the sleeve members 56', 70' in position. The PDC or diamond bearing elements 76, 78, and 80 are typically polished to a specific luster and surface friction, and have an exposed friction surface. These bearing elements are typically comprised of a PDC layer or external face bound to a substrate, such as a WC substrate or the like, which are attached to the sleeve members 56', 70' and disc 86 using any appropriate attachment means including, but not limited to, brazing, welding, adhesives, pressing, shrink-fitting, and the like, alone or in combination. Further, while the bearing elements 76, 78, and 80 in FIG. 6 are shown as generally rectangular or circular in shape, it will be appreciated that they may be of any desired shape, such as triangular and hexagonal, and that they may be oriented on the sleeve (or disc) in an arranged, substantially symmetrical manner as illustrated, or they may be oriented in random patterns and/or combinations of shapes of bearing elements, so as to maximize bearing efficiency and bit life.

In FIG. 7, a rear perspective view of an exemplary cutting cone assembly in accordance with aspects of the present disclosure is shown, illustrating the interior regions of the cone 32 and the bearing means mounted therein. In particular, the cone 32 may include within its interior recesses one or more of a first, outer, cylindrically-shaped bearing assembly 83 spaced below the ball race 59 within the cutter 32; a second, cylindrically-shaped bearing assembly 89 spaced above the ball race 59 and adjacent the cylindrical face 68 of cutter 32, which is shaped to fit the pilot pin assembly of spindle 52; and, a planar thrust bearing assembly 85 spaced above the ball race 59 substantially perpendicular to, and intermediate between, assemblies 83 and 89. Each of these bearing assemblies 83, 85, and 89 further comprise a plurality of PDC bearing elements mounted on or within sleeve assemblies using brazing or other appropriate techniques. The bearing assemblies may be retained in place within cone 32 using one or more flanges as appropriate, and similar to those described with reference to FIG. 6.

In operation, cone 32 rotates about the spindle assembly 52, while the bit body 24 of bit 20 is rotated. Bearing sleeves 56', 70' and disc 86 will remain stationary with the journal and pilot pins 56, 64, and lubricant contained in the bearing spaces is sealed by the dynamic interface between the interior faces of the cutter cone 32 and the exterior bearing faces of the bearing assemblies 83, 85, and 89. In accordance with certain embodiments of the present disclosure, the bearing assembly may be on just the spindle assembly 52, as shown generally in FIG. 6. Alternatively and equally acceptable, in accordance with certain aspects of the disclosure, the bearing assembly used with a drill bit may be just that bearing assembly similar to that shown generally in FIG. 7, that is, a bearing assembly within cutter cone 32, which mates with a standard spindle assembly on the bit leg. Finally, and equally acceptable, earth boring drill bits of the present disclosure may include both a bearing assembly of FIG. 6 on the exterior of spindle 52, and a bearing assembly similar to that in FIG. 7 on the interior region of the cutter cone 32, where the bearing means of both components act together to provide stronger bearing means for the drill bit with extended life and increased resistance to the mechanical stresses typically encountered. In further accordance with this aspect of the disclosure, the PDC-type bearing elements, e.g., bearing elements 76 and 77, may be arranged such that when cutter cone 32 is mounted on spindle assembly 52, the bearing elements are in alignment with each other. Alternatively and equally acceptable, all of the bearing elements may be out of alignment with each other, or some may be in alignment and others may not. For example, bearing elements 78 and 76 on spindle assembly 52 may be in alignment with correspondingly shaped and spaced bearing elements 77 and 79 on the interior of cutter cone 32, but thrust bearings 86 on the spindle assembly 52 may not be in alignment with the corresponding shoulder bearing elements 81 on the interior of cone 32.

Figure 8:
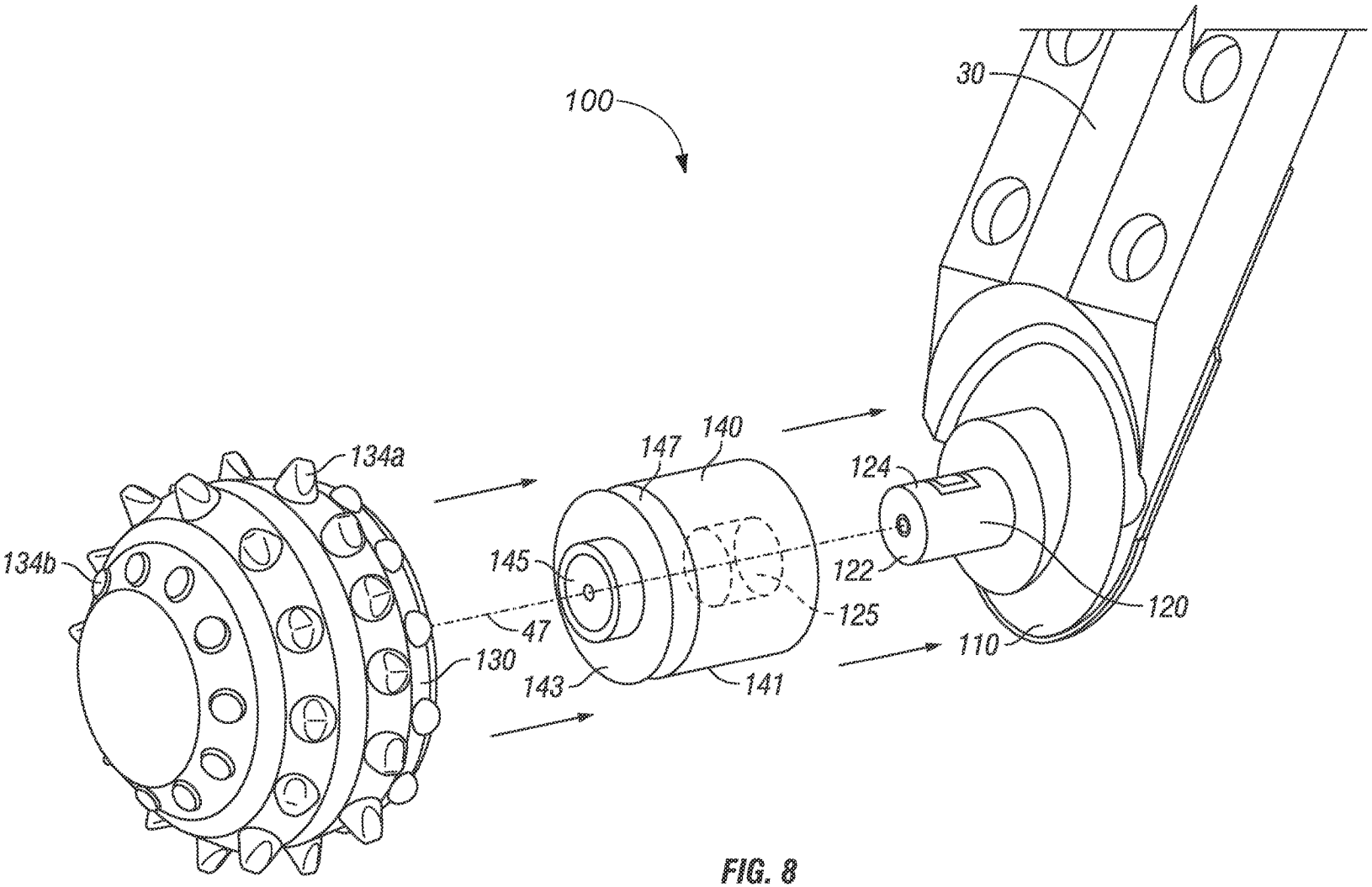
FIG. 8 illustrates an isometric, exploded view of a divorced bearing assembly in accordance with aspects of the present disclosure.
Figure 9:
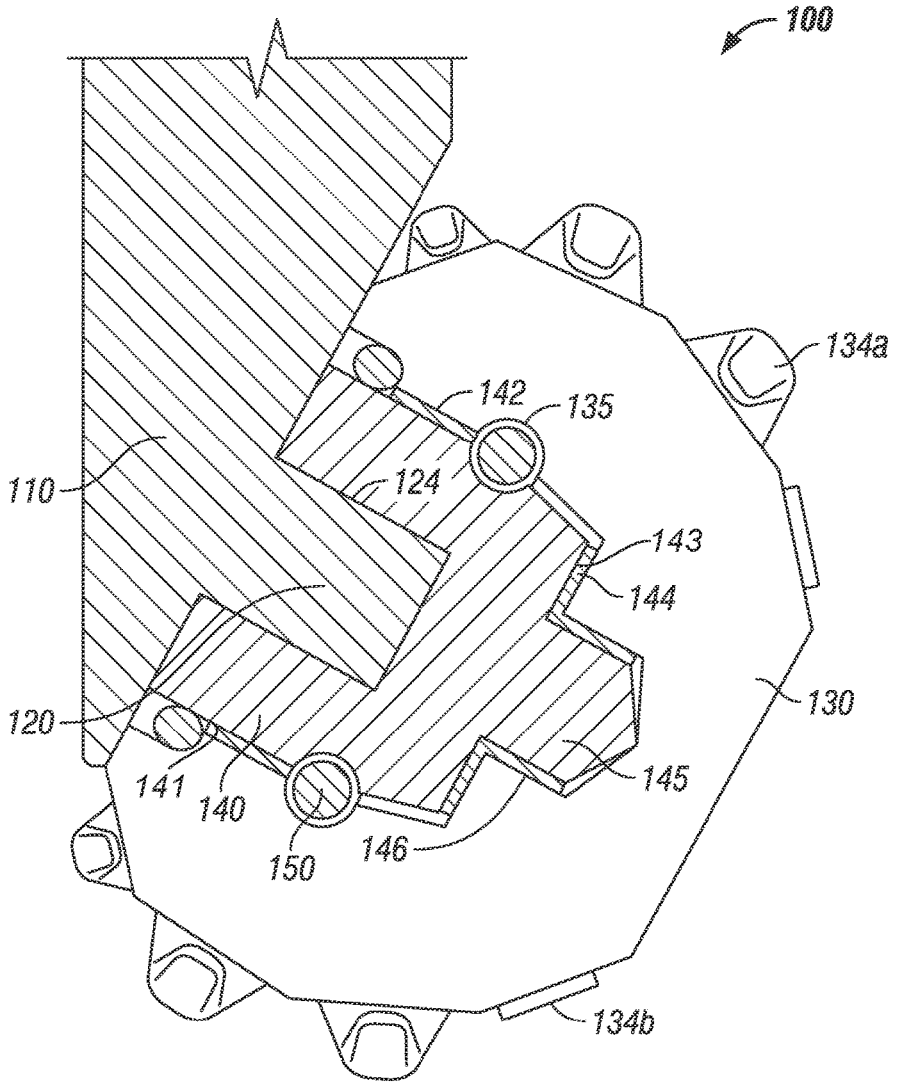
FIG. 9 illustrates a cross-sectional view of the embodiment illustrated generally in FIG. 8, in connection with the bit leg head and a hybrid rolling cutter.

FIGS. 8 and 9 illustrate a further bearing assembly arrangement in accordance with aspects of the present disclosure. FIG. 8 illustrates an exploded, isometric view of an exemplary, alternative bearing assembly arrangement. FIG. 9 illustrates a cross-sectional view of a portion of a drill bit leg assembly of FIG. 8 in an exemplary assembled configuration. These figures will be described in conjunction with each other.

An isometric, exploded view of bearing assembly system 100 in accordance with aspects of the instant disclosure is shown in FIG. 8. The assembly system 100 includes a roller cone leg 30, for use with a hybrid or other type of drill bit which includes a roller cone assembly, a divorced, external bearing assembly 140, and a rolling cutter 130. Roller cone leg 30 has, either formed thereon or fixedly attached, a substantially cylindrical head pin 120 at the distal, shirt-tail or head region 110 of the leg 30. Divorced, external bearing assembly 140 allows for the use of PDC-type bearing surfaces to be used in conjunction with rolling cones in earth-boring drill bits, but which can be readily removed and replaced or refurbished upon wear, at less cost than that associated with having to replace the entire cone leg and spindle region of the leg. This bearing assembly also advantageously allows for customization of the bearing means placement in response to the type of formation being drilled, and the amount of thrust and drilling stresses anticipated to be placed upon the roller cones on the drill bit.

The divorced, external bearing assembly 140 generally forms two portions—a journal region 141 having a first diameter disposed at a base of the bearing assembly 140, and a pilot pin region 145 having a second diameter less than that of the diameter of journal region 141 adjacent the journal region 141 and extending axially along the axis of rotation 47. A shoulder region 143 is established as a result of the different diameters between the journal region 141 and the pilot pin region 145. Intermediate between shoulder region 143 and journal region 141 is a groove, or race 147 machined into and circumscribing the nose of region 141 suitable for holding appropriate cone retention means, including ball bearings, retaining rings, and the like which are packed into the race 147 and which are capable of aiding in locking the cone 130 onto the drill bit's leg via divorced external bearing assembly 140. External bearing assembly 140 also comprises an internal, substantially cylindrical recess 125 formed within the axial center of assembly 140, sized and shaped to receive head pin 120 therein. The journal, pilot pin, and shoulder regions, in combination, support a rolling cutter 130 having a plurality of cutting elements 134, the rolling cutter 130 being rotatably disposed about the journal and pilot pin regions of bearing assembly 140.

Turning to FIG. 9, a cross-sectional side-view of the exploded assembly system 100 of FIG. 8 is illustrated, showing the inter-relation of all the elements of the system. As shown therein, when assembled, the hybrid cone cutter 130 is rotatively mounted on the external, divorced bearing assembly 140, which is in turn fixedly mounted on head pin 120 extending out of the head region 110 of the leg 30. In particular, the axial and cylindrical regions 122 and 124, respectively, of head pin 120 are shaped and adapted so as to engage the recess 125 within divorced bearing assembly 140. The bearing assembly 140 further includes a cylindrical face of journal region 141, an axial face of shoulder region 143, and a cylindrical face of pilot pin region 145, all of which are adapted to oppose and engage the corresponding axial and cylindrical faces formed in the annular, interior regions of cone 130. Intermediate between these inter-engaging axial and cylindrical surfaces are one or more bearing means, particularly journal bearing means 142, thrust bearing means 144, and/or pilot pin bearing means 146 circumscribing the exterior faces of divorced bearing assembly 140. Suitable bearing means for use in accordance with this aspect of the present disclosure include flat, polished bearings, sometimes called friction or plain bearings, which circumscribe the exterior face of a region, roller bearings consisting of solid cylinders of metal packed side-by-side and circumscribing cylindrical regions of the assembly 140, and polycrystalline diamond compact (PDC) bearing elements of varied shape and thickness, such as shown in association with FIGS. 6-7, discussed herein. While not shown in the figure, one or more retaining flanges may be included in the assembly in order to retain the bearing means in place on the exterior face of divorced bearing assembly 140.

As further illustrated in FIG. 9, the bearing assembly's race 147 registers with a similarly-shaped race 135 formed in cutter 130 for receiving retaining means, such as ball bearings, a retaining ring, or the like to assist in holding the cone 130 on the bearing assembly 140. The retaining means may also function as a bearing structure in accordance with aspects of the present disclosure. While not shown in the figures, it is envisioned that an interior apex of cone 130 may optionally further include an annular recess for receiving a thrust button on the axial end of assembly 140.

While not shown in the Figures, it is envisioned that the bearing assembly 140 of FIGS. 8 and 9 may also be manufactured such that at least the cylindrical exterior regions 141 and 145 include a machined annular groove or slot in the cylindrical regions, and that the assembly further includes a sleeve capable of mating with the annular groove or slot in the exterior regions 141 and 145, the sleeve being held in place either by way of a separate, annular retaining ring or similar retaining means, or by welding the ends of the sleeve into the groove or slot. This sleeve may be in one piece, or a plurality of sections, such that the overall sleeve circumscribes the journal and pin regions 141 and 145. The sleeve may be made of any number of materials, providing that at least the exterior-facing region of it comprises a substrate, such as any number of carbides or the like, to which a plurality of hardened bearing material such as nickel- or cobalt-based materials, diamond, or polished PDC bearings as described above may be mounted or bonded to or in, using brazing or the like. This plurality of bearing means on the sleeve cooperates with surfaces or bearing surfaces opposite it associated with the interior of a cutting cone so as to support and resist radial, longitudinal and/or thrust loads acting on the cutter.

Other and further embodiments utilizing one or more aspects of the inventions described above can be devised without departing from the spirit of Applicant's invention. Further, the various methods and embodiments of the bearing assemblies associated with earth boring drill bits as described herein can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A hybrid rotary drill bit comprising:

a bit body;

at least one fixed blade extending in an axial direction downwardly from the bit body and having at least one fixed cutting element disposed thereon;

at least one rolling cutter leg extending in an axial direction downwardly from the bit body;

a rolling cutter rotatably coupled to the at least one rolling cutter leg and having an interior recess formed within the rolling cutter, the recess comprising a circumferential groove;

at least one cutting element disposed on the rolling cutter; and a divorced rolling cutter bearing assembly configured to removably engage a portion of the at least one rolling cutter leg and comprising:

a) a first bearing sleeve assembly configured to engage the recess; or b) first and second cylindrically-shaped bearing sleeve assemblies each configured to engage different portions of the recess on either side of the groove; or c) a planar thrust bearing assembly configured to engage a portion of the recess;

the divorced rolling cutter bearing assembly comprising at least one bearing element coupled to an external portion of the divorced rolling cutter bearing assembly and configured to facilitate rotation between the rolling cutter and the at least one roller cutter leg.

2. The bit of claim 1, wherein the bit comprises two rolling cutter legs, two rolling cutters, and two fixed blades, each extending in the axial direction downwardly from the bit body.

3. The bit of claim 1, further comprising a ball race formed in and circumscribing a region of the bearing assembly, the ball race shaped to coordinate with a ball race formed in the rolling cutter.

4. The bit of claim 1, wherein the at least one bearing element is a PDC or diamond bearing element attached to a portion of the divorced bearing assembly using brazing, welding, adhesives, pressing, or shrink-fitting, alone or in combination.

5. The bit of claim 1, wherein the at least one fixed cutting element is adapted to remove formation at or near the axial center of the drill bit.

6. The bit of claim 1, wherein the rolling cutter is truncated.

7. The bit of claim 6, wherein the at least one rolling cutter cutting element is radially spaced apart from an axial center of the bit body.

8. The bit of claim 1, wherein the at least one fixed blade is adapted to remove formation at or near the axial center of the drill bit; wherein the rolling cutter is truncated; and wherein the at least one fixed blade and the rolling cutter are configured to form a cutting profile from adjacent an axial centerline of the bit to a shoulder region of the bit.

9. The bit of claim 1, wherein the first bearing sleeve further comprises a plurality of PDC bearing elements mounted on or within a face of the first bearing sleeve facing toward the interior recess of the rolling cutter.

10. The bit of claim 9, wherein at least one of the PDC bearing elements on the divorced bearing assembly are in alignment with the PDC bearing elements on the first bearing sleeve within the interior recess of the rolling cutter.

11. The bit of claim 1, further comprising a plurality of PDC or diamond bearing elements fixed to the first bearing sleeve, the second bearing sleeve assembly or the planar thrust bearing assembly.

12. The bit of claim 11, wherein the recess groove is a bearing race and operatively corresponds to a bearing race formed in the divorced bearing assembly.

13. The bit of claim 1, further comprising first and second bearing sleeve assemblies and a planar thrust bearing assembly, each of which is configured to operatively engage corresponding bearing structures on the divorced bearing assembly.

14. A hybrid rotary drill bit comprising:

a bit body;

at least one fixed blade extending in an axial direction downwardly from the bit body and having at least one fixed cutting element disposed thereon;

at least one rolling cutter leg extending in an axial direction downwardly from the bit body;

a rolling cutter rotatably coupled to the at least one rolling cutter leg, the rolling cutter comprising an interior recess comprising a circumferential groove formed within the rolling cutter;

at least one cutting element disposed on the rolling cutter;

a divorced rolling cutter bearing assembly configured to removably engage a portion of the at least one rolling cutter leg and configured to have a journal portion, a pin portion and a thrust surface, the bearing assembly comprising:

at least one bearing element coupled to an external portion of the divorced rolling cutter bearing assembly and configured to facilitate rotation between the rolling cutter and the leg;

the rolling cutter having a recess configured with structures corresponding to the journal portion, pin portion and thrust surface of the bearing assembly;

a first rolling bearing race formed in the divorced bearing assembly;

a second rolling bearing race formed in the rolling cutter recess and operatively aligned with the first rolling bearing race;

a plurality of rolling bearing elements disposed in the first and second rolling bearing races to removably secure the rolling cutter to the bit leg;

a plurality of PDC bearing elements or diamond bearing elements disposed between the journal portion and the corresponding structure of the rolling cutter, a plurality of PDC bearing elements or diamond bearing elements disposed between the pin portion and the corresponding structure of the rolling cutter;

a plurality of PDC bearing elements or diamond bearing elements disposed between the thrust surface and the corresponding structure of the rolling cutter.

15. A method of rehabilitating the hybrid rotary drill bit of claim 1 comprising:

removing the at least one rolling cutter from the at least one bit leg;

removing the divorced bearing assembly from the at least one bit leg;

coupling a different or new divorced bearing assembly to the at least one bit leg;

coupling a different or new rolling cutter to the at least one bit leg.

16. A method of rehabilitating the hybrid rotary drill bit of claim 1 comprising:

removing the at least one rolling cutter from the at least one bit leg;

removing the divorced bearing assembly from the at least one bit leg;

coupling a different or new divorced bearing assembly to the at least one bit leg;

coupling a different or new rolling cutter to the at least one bit leg.

17. A method of rehabilitating the hybrid rotary drill bit of claim 14 comprising:

removing the at least one rolling cutter from the at least one bit leg;

removing the divorced bearing assembly from the at least one bit leg;

coupling a different or new divorced bearing assembly to the at least one bit leg;

coupling a different or new rolling cutter to the at least one bit leg.

* * * * *